US011238728B2

(12) United States Patent
Xu et al.

(10) Patent No.: US 11,238,728 B2
(45) **Date of Patent: *Feb. 1, 2022**

(54) DETERMINING TRAFFIC CONGESTION PATTERNS

(71) Applicant: International Business Machines Corporation, Armonk, NY (US)

(72) Inventors: Jing Xu, Xian (CN); Xiaoyang Yang, San Francisco, CA (US); Ji Hui Yang, Xian (CN); Jun Wang, Xian (CN); Jing Xu, Xian (CN)

(73) Assignee: International Business Machines Corporation, Armonk, NY (US)

( * ) Notice: Subject to any disclaimer, the term of this patent is extended or adjusted under 35 U.S.C. 154(b) by 35 days.

This patent is subject to a terminal disclaimer.

(21) Appl. No.: 16/438,436

(22) Filed: Jun. 11, 2019

(65) Prior Publication Data

US 2019/0325742 A1 Oct. 24, 2019

Related U.S. Application Data

(63) Continuation of application No. 15/956,271, filed on Apr. 18, 2018.

(51) Int. Cl.
*G08G 1/08* (2006.01)
*G08G 1/01* (2006.01)
(Continued)

(52) U.S. Cl.
CPC ..... *G08G 1/0133* (2013.01); *G08G 1/048* (2013.01); *G08G 1/052* (2013.01)

(58) Field of Classification Search
CPC ..... G08G 1/0133; G08G 1/052; G08G 1/048; G08G 1/0145; G08G 1/0129
(Continued)

(56) References Cited

U.S. PATENT DOCUMENTS 9,240,123 B2 1/2016 Stenneth
9,536,424 B2 * 1/2017 Macfarlane ..... G08G 1/0116
(Continued)

FOREIGN PATENT DOCUMENTS

CN 100570664 12/2009
CN 103903436 A 7/2014
CN 104464307 B 8/2016

OTHER PUBLICATIONS

Huimin Wen et al., "Study on Traffic Congestion Patterns of LargeCity in China Taking Beijing as an Example", Procedia—Social and Behavioral Sciencesvol. 138, pp. 482-491, https://www.sciencedirect.com/science/article/pii/S1877042814041469, Jul. 14, 2014.

(Continued)

*Primary Examiner* — Dalena Tran
(74) *Attorney, Agent, or Firm* — Jeffrey S LaBaw; Anttiony V England

(57) ABSTRACT

Embodiments generally relate to determining traffic congestion patterns. In some embodiments, a method includes identifying congestion events for each road of a plurality of roads in a road network, where each congestion event indicates a drop in average vehicle speed below a predetermined speed threshold for a particular road in the road network, and where the congestion events span a predetermined time period. The method further includes determining local clusters of the congestion events based on one or more road condition parameters, where each local cluster defines a local congestion pattern for a particular road of the plurality of roads in the road network. The method further includes grouping the local clusters into one or more global clusters based on the one or more road condition parameters, where the global clusters define global congestion patterns in the road network.

11 Claims, 8 Drawing Sheets

(51) Int. Cl.
*G08G 1/052* (2006.01)
*G08G 1/048* (2006.01)

(58) Field of Classification Search
USPC ..... 701/119; 707/737, 791
See application file for complete search history.

(56) References Cited

U.S. PATENT DOCUMENTS

| | | | | |
|---|---|---|---|---|
| 10,002,530 | B1 * | 6/2018 | Liu | G08G 1/08 |
| 10,545,247 | B2 | 1/2020 | Zheng et al. | |
| 2001/0027373 | A1 | 10/2001 | Bates et al. | |
| 2007/0118281 | A1 * | 5/2007 | Adam | G08G 1/096783 701/431 |
| 2009/0112452 | A1 * | 4/2009 | Buck | G08G 1/09675 701/117 |
| 2011/0160988 | A1 | 6/2011 | Rogers | |
| 2014/0278031 | A1 * | 9/2014 | Scofield | G08G 1/096888 701/118 |
| 2016/0196527 | A1 * | 7/2016 | Bose | H04W 4/021 705/332 |
| 2018/0240026 | A1 * | 8/2018 | Pietrobon | G08G 1/0133 |
| 2020/0064139 | A1 | 2/2020 | Mieth et al. | |
| 2020/0160695 | A1 * | 5/2020 | Liu | G08G 1/0141 |

OTHER PUBLICATIONS

List of IBM Patents or Applications Treated as Related.

Ramon Bauza et al., "Road traffic congestion detection through cooperative vehicle to vehicle communications", Local Computer Networks (LCN), 2010 IEEE 35th Conference on, https://ieeexplore.ieee.org/document/5735780, Oct. 10, 2010.

Ramon Bauza et al., "Traffic congestion detection in large scale scenarios using vehicle to vehicle communications", Journal of Network and Computer Applications, vol. 36, Issue 5, pp. 1295-1307, https://www.sciencedirect.com/science/article/pii/S1084804512000628, Sep. 2013.

Siuli Roy et al., "Real time traffic congestion detection and management using Active RFID and GSM technology", Indian Institute of Management Calcutta, India, https://pdfs.semanticscholar.org/ba47/b2c0c3a209ec463109863d725d9a28435da4.pdf, [retrieved Dec. 20, 2017].

* cited by examiner

100

300

400

600

700

800

DETERMINING TRAFFIC CONGESTION PATTERNS

BACKGROUND

Traffic congestion is associated with many critical issues such as energy consumption and air pollution. Various methods have been designed to resolve or alleviate these issues. For example, some systems monitor traffic and display street maps with color-coding that indicate traffic status. For example, the color red may indicate traffic congestion (e.g., under 10 miles per hour). Such traffic status may help to reduce travel time by guiding drivers around congested roads. Such methods, however, do not compute traffic congestion patterns and do not determine reasons for congestion.

SUMMARY

Disclosed herein is a method for determining traffic congestion patterns, and a system and computer program product as specified in the independent claims. Embodiments are given in the dependent claims. Embodiments can be freely combined with each other if they are not mutually exclusive.

In an embodiment, a method includes identifying congestion events for each road of a plurality of roads in a road network, where each congestion event indicates a drop in average vehicle speed below a predetermined speed threshold for a particular road in the road network, and where the congestion events span a predetermined time period. The method further includes determining local clusters of the congestion events based on one or more road condition parameters, where each local cluster defines a local congestion pattern for a particular road of the plurality of roads in the road network. The method further includes grouping the local clusters into one or more global clusters based on the one or more road condition parameters, where the global clusters define global congestion patterns in the road network.

In another aspect, the at least one processor further performs operations including identifying each road in the road network based on a road location in the road network. In another aspect, to determine the local clusters, the method further includes determining, for each road, parameter measurements for each of the one or more of the road condition parameters; and grouping the congestion events into the local clusters based on the road condition parameter measurements. In another aspect, the one or more road condition parameters include traffic parameters. In another aspect, the one or more road condition parameters include weather parameters. In another aspect, each congestion event is a regular congestion event. In another aspect, the method further includes determining, for each congestion event, if the congestion event is an abnormal congestion event.

DETAILED DESCRIPTION

Embodiments described herein facilitate determination of traffic congestion patterns in a road network. As described in more detail herein, a system detects congestion events and determines traffic congestion patterns based on those congestion events.

As described in more detail herein, embodiments apply a clustering method separately on each road in order to determine local traffic congestion patterns for individual roads. Embodiments also apply a clustering method on the traffic congestion patterns in order to determine global traffic congestion patterns for the road network.

In some embodiments, a system identifies congestion events for each road in a road network, where each congestion event indicates a drop in average vehicle speed below a predetermined speed threshold for a particular road in the road network, and where the congestion events span a predetermined time period. The system further determines local clusters of the congestion events based on one or more road condition parameters, where each local cluster defines a local congestion pattern for a particular road in the road network. The system further groups the local clusters into one or more global clusters based on the one or more road condition parameters, where the global clusters define global congestion patterns in the road network.

Figure 1:
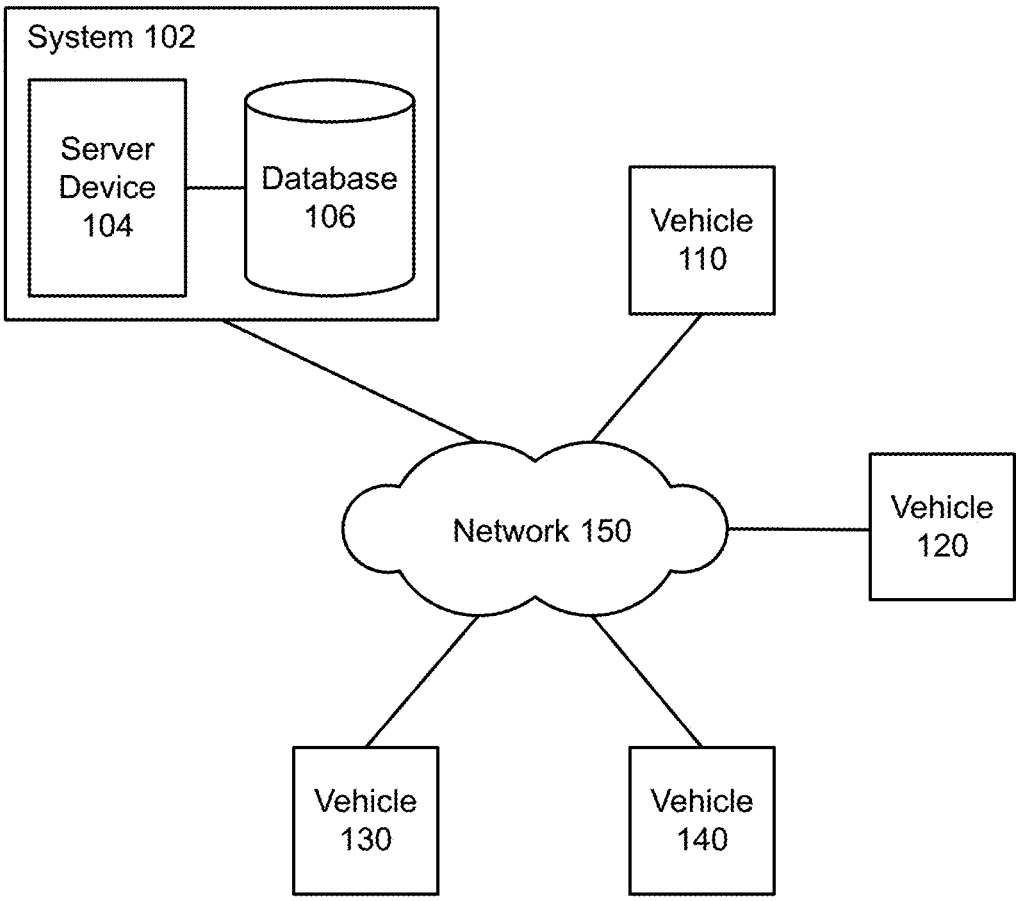
FIG. 1 is an example environment with a system that determines traffic congestion patterns, according to some embodiments.

FIG. 1 is an example environment 100 for determining traffic congestion patterns, according to some embodiments. Shown is a system 102, which includes a server device 104 and a database 106. The system 102 communicates with vehicles 110, 120, 130, and 140 via communications network 150. The network 150 may be any network such as a wireless local area network (WLAN), the Internet, or any combination thereof including other networks.

As described in more detail herein, the system 102 analyzes historical traffic data associated with vehicles such as vehicles 110, 120, 130, and 140. The traffic data may be stored in database 106 and/or in any suitable database. Such traffic data may include, for example, the average speed of traffic on various roads in a road network, as well as changes in the average speed of traffic during a predetermined time period (e.g., during a 24-hour period).

The system 102 detects congestion events from the traffic data and determines traffic congestion patterns based on those congestion events. The system 102 determines traffic congestion patterns at a local road level (individual roads) as well as a global road network level (general road network).

For ease of illustration, FIG. 1 shows one block for each of system 102, server device 104, and database 106, and shows four blocks for vehicles 110, 120, 130, and 140. Blocks 102, 104, and 106 may represent multiple systems, server devices, and databases. Also, there may be any number of vehicles driving on various streets in a geographic area (e.g., a neighborhood, city, etc.). In other implementations, the environment 100 may not have all of the components shown and/or may have other elements including other types of elements instead of, or in addition to, those shown herein.

While the system 102 performs embodiments described herein, in other embodiments, any suitable component or combination of components associated with the system 102 or any suitable processor or processors associated with the system 102 may facilitate performing the embodiments described herein. In various embodiments, the environment 100 may not have all of the components shown and/or may have other elements including other types of components instead of, or in addition to, those shown herein.

Figure 2:
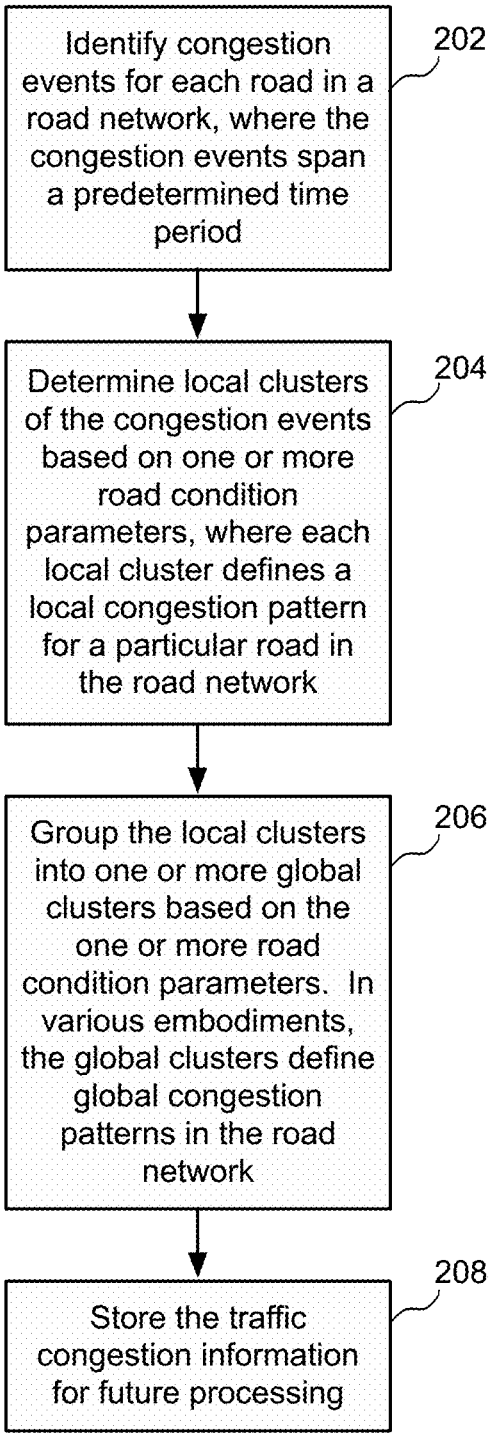
FIG. 2 is an example flow diagram for determining traffic congestion patterns, according to some embodiments.

FIG. 2 is an example flow diagram for determining traffic congestion patterns from data containing traffic conditions, according to some embodiments. In various embodiments, the traffic condition data are existing historical data, and the congestion events and congestion patterns are determined from the historical data. In some embodiments, the data may include real-time data that is added to the existing data. As such, for determining congestion events and congestion patterns the system may fetch traffic condition data from real-time data, historical data, or both for any given time period (e.g., particular times of a day, a particular day, a particular set of days, etc.).

As indicated herein, the system determines traffic congestion patterns in a road network at a local road level as well as a global road network level. Steps of determining traffic congestion patterns may be grouped into two phases based on multi-dimensional or spatial characteristics of congestion (e.g., street-level or local traffic congestion patterns, road network-level or global traffic congestion patterns). As described in more detail herein, in the first phase, the system applies a clustering method separately on each road in order to determine local traffic congestion patterns for individual roads. In the second phase, the system applies a clustering method on the traffic congestion patterns in order to determine global traffic congestion patterns for the road network.

Referring to both FIGS. 1 and 2, a method begins at block 202, where a system such as system 102 identifies congestion events for each road in a road network. In various embodiments, each congestion event indicates for one or more vehicles on a given road a drop below a predetermined speed threshold in average vehicle speed of the vehicle(s). Each congestion event is determined for each particular road in the road network. In some embodiments, the system may identify each road in the road network based on a road location in the road network. The system may also identify portions of each road that experience traffic congestion (e.g., the portion of a given street between two cross streets, etc.), and may determine congestion events, etc. for respective road portions. Accordingly, it should be understood that references herein to roads may be interpreted as road portions for at least some embodiments of the invention. Further, the terms "street" and "road" may be used interchangeably herein.

In various embodiments, the congestion events span a predetermined time period. For example, the system may identify congestion events that occur over 24 hours in on a given weekday, group of weekdays, a weekend day, a whole weekend, etc. Example embodiments are described in more detail herein.

Figure 3:
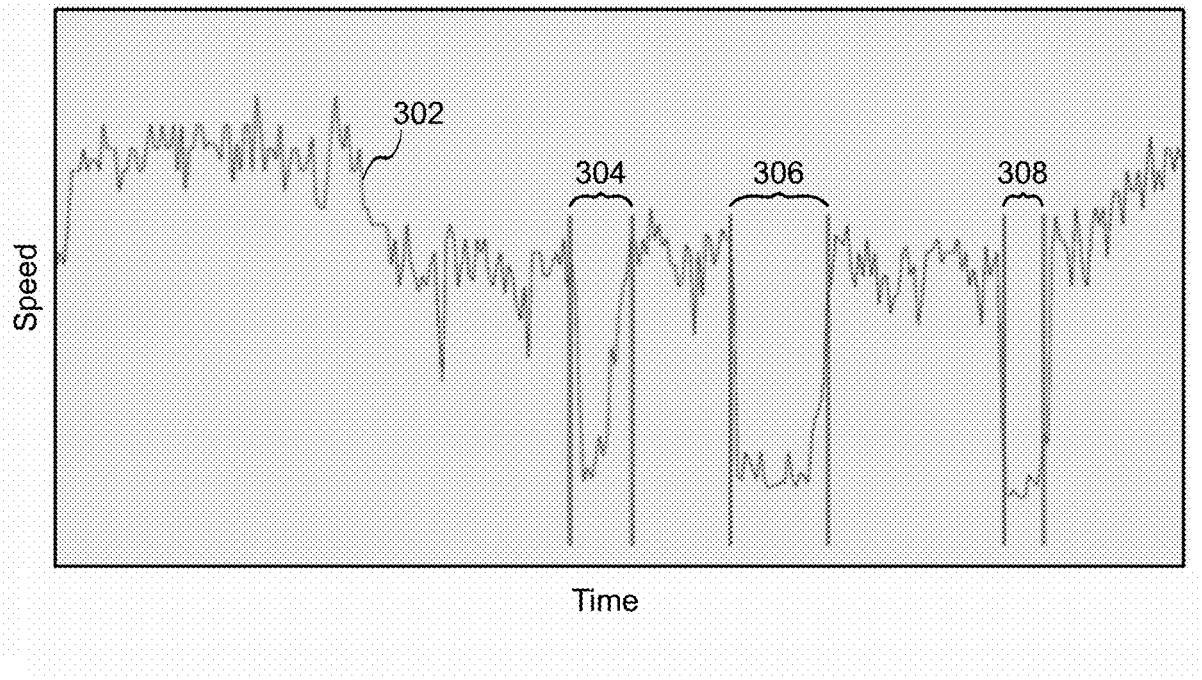
FIG. 3 is an example graph showing congestion events, according to some embodiments.

FIG. 3 is an example graph 300 showing congestion events, according to some embodiments. In this example, the vertical axis or y-axis represents the average speed of vehicles on a given road, and the horizontal axis or x-axis represents time. The system may retrieve this traffic data from the database 106 of FIG. 1, or any suitable database.

Shown is a plot or line 302 that represents the average speed of vehicles as a function of time. As shown, the average speed varies throughout the time period. In this example, the time period shown in the graph 300 spans over a 24-hour period. The time period may vary depending on the particular implementation. For example, another graph may show traffic over a weekend, etc.

Also shown are congestion events 304, 306, and 308. A congestion event is a process of congestion from start (arising traffic congestion) to end (diminishing traffic congestion) on a particular road. For example, during congestion event 304, there is a significant drop in average speed. For example, if the average speed through out the day ranges between 30 and 40 miles per hour, a significant drop in average speed may be a drop below a predetermined threshold such as 15 miles per hour. The predetermined threshold may vary, depending on the particular implementation. For example, if the predetermined threshold may be higher for highways and lower for streets. In some implementations, the predetermined threshold may be a predetermined percentage (e.g., 50%) of the average speed of vehicles or speed limit, etc.

In this particular example, the congestion event 304 may represent traffic congestion during a morning commute period (e.g., between 8 AM and 9 AM). The congestion event 306 may represent traffic congestion during a lunchtime period (e.g., between 11 AM and 2 AM). The congestion event 308 may represent traffic congestion during an evening commute period (e.g., between 5 AM and 6 AM). The actual duration of a given congestion event will vary from congestion event to congestion event.

In some embodiments, to identify a given congestion event, the system identifies and selects a stable congestion seed. A stable congestion seed may a set of points in the graph where the average speed drops below the predetermined speed threshold for a certain time period (e.g., 30 seconds, 45 seconds, 60 seconds, etc.). The time period may vary depending on the implementation.

The system then searches backward in time to determine the start time of the congestion, and searches forward in time to determine the end time of the congestion. In some embodiments, the start of the congestion event may be the moment the average speed of traffic drops below the predetermined speed threshold, and the end of the congestion event may be the moment the average speed of traffic increases above the predetermined speed threshold.

Referring again to FIG. 2, at block 204, the system determines local clusters of the congestion events based on one or more road condition parameters. In various embodiments, each local cluster defines a local congestion pattern for a particular road in the road network. Road condition parameters and local congestion patterns are described in more detail in connection with FIG. 4.

Figure 4:
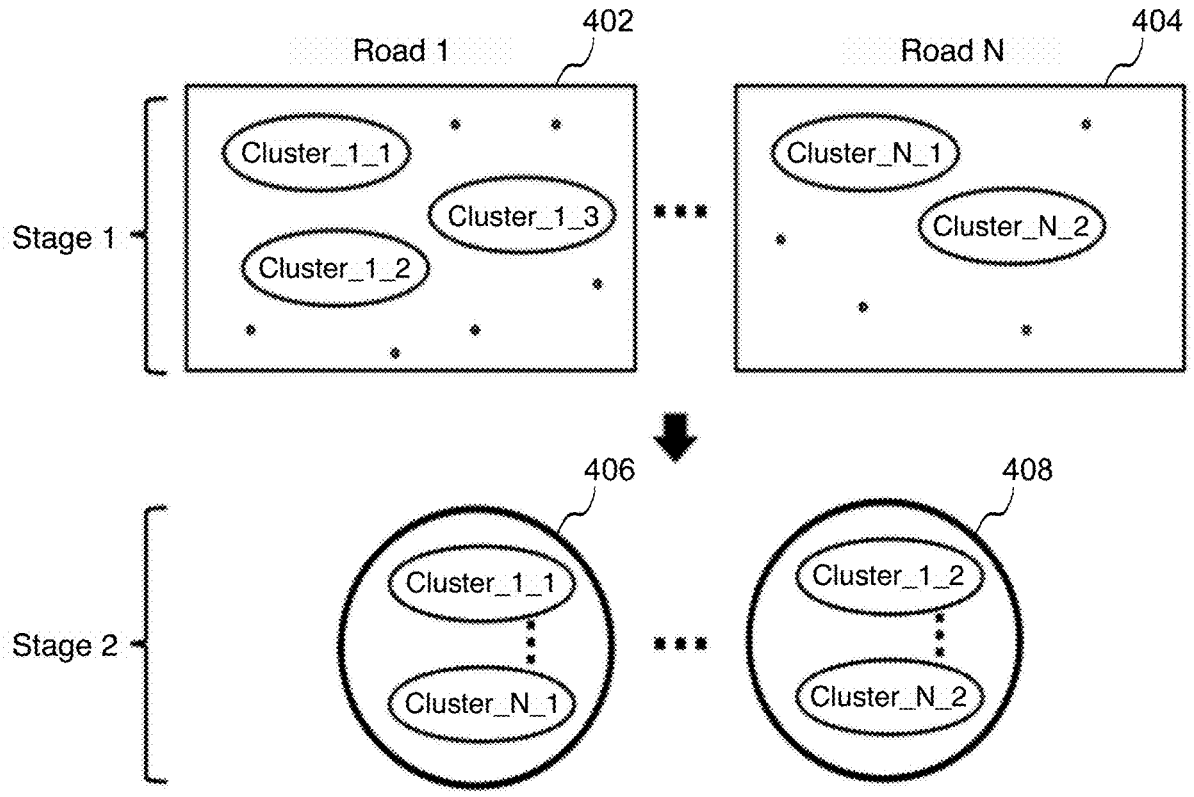
FIG. 4 is an example block diagram showing two stages for determining traffic congestion patterns, according to some embodiments.

FIG. 4 is an example block diagram 400 showing two stages for determining traffic congestion patterns, according to some embodiments. Shown is a first stage, or Stage 1, and a second stage, or Stage 2.

In Stage 1, the system groups congestion events into clusters separately for each road, Road 1 through Road N. For example, shown is a set of clusters 402 associated with Road 1, and a set of clusters 404 associated with Road N. Such clusters in Stage 1 may be referred to as "local clusters" or "sub-clusters" in order to distinguish them from the clusters obtained in Stage 2. In various embodiments, each sub-cluster defines a local congestion pattern on the road, where the system profiles each sub-cluster by a specified set of metrics or parameters. A congestion pattern may be described by the distributions of attributes, which have been used in the profiling of congestion events. Example attribute may include congestion time, queuing length, average speed, weather conditions, etc. Because there are various possible attributes, the system may select particular attributes to describe a given congestion pattern for simplicity.

As shown, the outcome of Stage 1 for Road 1 includes a particular number of clusters Cluster_1_1, Cluster 1_2, and Cluster 1_3. Cluster_1_1 may include congestion events that occur during a particular time period (e.g., traffic congestion occurring between 12 PM and 1 PM). Cluster_1_2 may include congestion events having different road condition parameters (e.g., traffic congestion occurring close to an intersection). As described in more detail herein, each local cluster may be associated with a combination of different road condition parameters.

The outcome of Stage 1 for Road N includes a particular number of clusters Cluster N_1 and Cluster N_2. Any clustering method with the option of outlier detection may be applied in Stage 1. In various embodiments, outlier events are excluded from the clustering process. Such outlier events are abnormal events, and indicated by small circles in Stage 1 of FIG. 4.

In some embodiments, to determine the local clusters, the system determines, for each road, parameter measurements or values for each of the one or more road condition parameters. Example road condition parameters are described in more detail herein. In various embodiments, the system characterizes, i.e., profiles, each congestion event. Each profile may include various attributes according to different types of road condition parameters, which are described in more detail herein.

In some embodiments, the system groups the congestion events into the local clusters based on the road condition parameter measurements. In some embodiments, one or more of the road condition parameters include traffic parameters. Such traffic parameters may also be referred to as basic parameters. Basic parameters may include congestion time, congestion persistent time, queuing length and queuing length variance, average driving speed, driving speed variance, average inflow/outflow volume, etc. The congestion time is the duration of the congestion event (e.g., 10 minutes, etc.), where a congestion event is a process from the congestion starting to the congestion ending. The vehicle queue length varies dynamically during the congestion event. The system may profile the queuing process generally by statistics including max, mean/average, and variance of queue length. The average speed is the average driving speed of traffic during the congestion event (e.g., 15 miles per hour, etc.). The driving speed variance is the amount of change of the average driving speed during the congestion event (e.g., a variance of 5 miles per hour, etc.). The inflow/outflow volume of vehicles is another metric, which indicates how many vehicles are passing the road in one-unit time (e.g., in one hour). Similar to the vehicle queue, the inflow/outflow volume also varies dynamically. Thus, the system may use the statistics (e.g., mean/average, variance, etc.) for the profiling.

In some embodiments, the one or more road condition parameters include weather parameters. Road condition parameters may also include proximity to an intersection or a merging point, weather conditions, etc. These road condition parameters may also be referred to as environmental parameters.

In some embodiments, the one or more road condition parameters include spatial parameters. Spatial parameters may include road location, proximity to other roads, proximity to highways, etc. In some embodiments, spatial parameters might not be included when grouping congestion events in the clustering method, because similar congestion events might not occur closely to each other in physical space. A random congestion even might not fall into a typical pattern for a given road. If the spatial parameter is omitted, such a congestion event may be a valid pattern in the road network. The spatial parameter may be used to distinguish local congestion patterns from global patterns. Local congestion patterns are identified on the local road level, while the global patterns are defined on the network. Without the spatial parameter, an occasional congestion that occurred on a road could be identified as a valid pattern if it is considered to be within the network. In some embodiments, such congestion may be declared as an exception for the road. As such, in some embodiments, the system treats spatial parameters in the second phase (Stage 2) in order to find meaningful congestion patterns at the road network level.

In various embodiments, the system analyzes each congestion event to determine measurements or values associated with the different parameters. Such multi-dimensional profiling of congestion events allows for detecting meaningful patterns of congestion events and deriving reasons for congestion events based on the various factors/parameters. In some embodiments, the system may then generate a profile for each road based on the values of the road condition parameters. Each road profile may include probable reasons for each congestion event.

Referring still to both FIGS. 2 and 4, at block 206, the system groups the local clusters into one or more global clusters based on the one or more road condition parameters. In various embodiments, the global clusters define global congestion patterns in the road network. A global cluster may be referred to as a cluster, and a local cluster may also be referred to as a sub-cluster, where a global cluster (cluster) is made up of local clusters (sub-clusters).

In Stage 2, all sub-clusters/local clusters are pooled together and grouped into a specified number of clusters/global clusters. Each global cluster defines a global congestion pattern in the road network, and each global cluster includes similar congestion events that happen in the road network. This allows for specific treatments on each type of congestion pattern. For example, cluster set 406 may include a sub-cluster Cluster_1_1 from Road 1, a sub-cluster Cluster_N_1, where these sub-clusters have similar characteristics. Similarly, cluster set 408 may include a sub-cluster Cluster_1_2 from Road 1, a sub-cluster Cluster_N_2 from Road N, where these sub-clusters have similar characteristics.

At block 208, the system may store the traffic congestion information for future processing. For example, in some embodiments, the system may enable a user to access the traffic congestion information associated with the local clusters and the global clusters. The system may display traffic congestion information to a user. The user may be planner such as a city planner, and may use the traffic congestion information for planning (e.g., to tune traffic lights). In some embodiments, each congestion event determined and analyzed by the system is a regular congestion event. As described in more detail herein, one or more congestion events may be abnormal congestion events.

Although the steps, operations, or computations may be presented in a specific order, the order may be changed in particular implementations. Other orderings of the steps are possible, depending on the particular implementation. In some particular implementations, multiple steps shown as sequential in this specification may be performed at the same time. Also, some implementations may not have all of the steps shown and/or may have other steps instead of, or in addition to, those shown herein.

Figure 5:
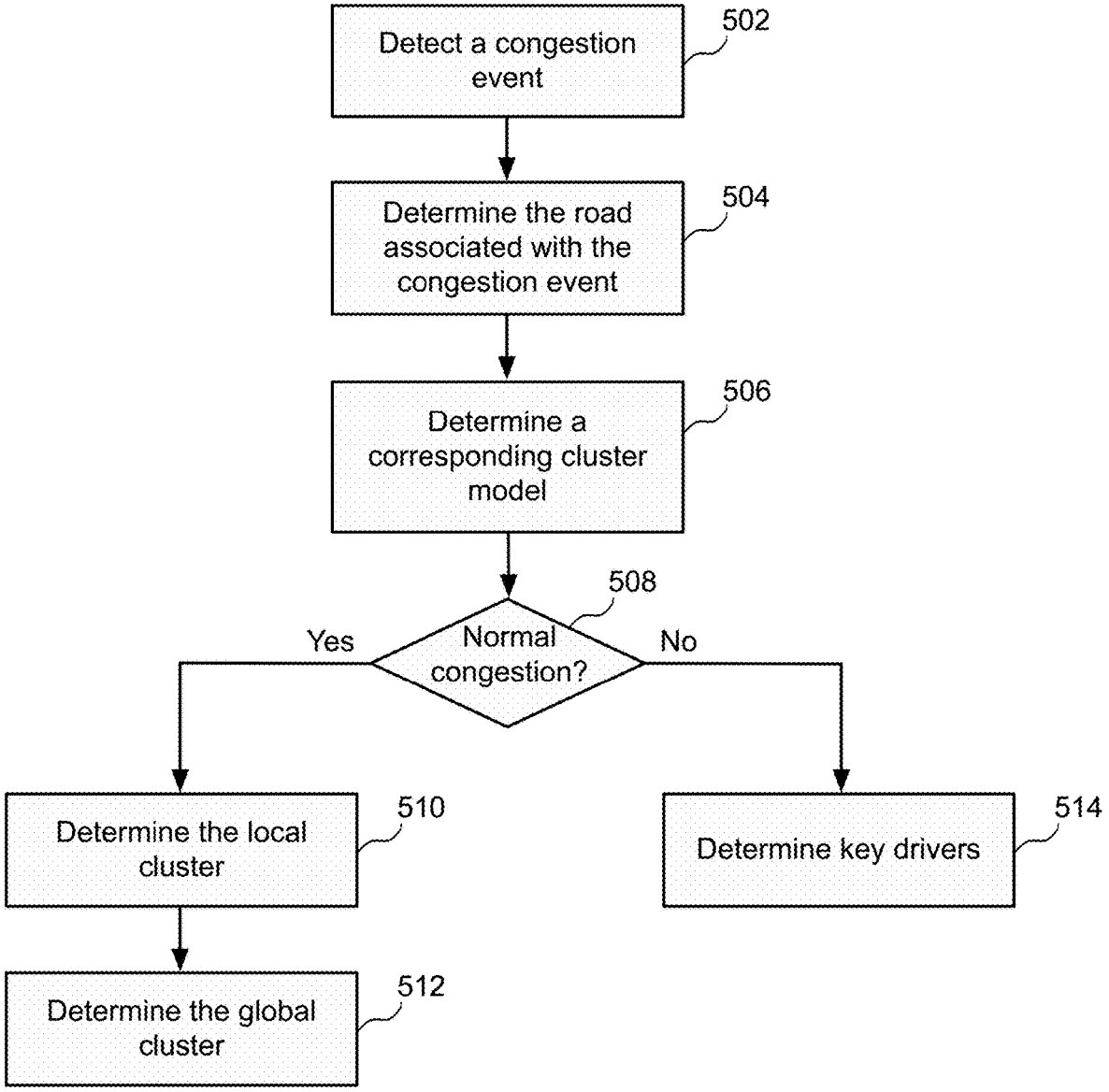
FIG. 5 is an example flow diagram for characterizing a congestion event, according to some embodiments.

FIG. 5 is an example flow diagram for characterizing a congestion event, according to some embodiments. As described in more detail herein, the system determines whether a detected traffic congestion pattern is a regular traffic congestion pattern or an abnormal traffic congestion pattern. The system may group a congestion event into a particular sub-cluster. Or, the system may determine that the congestion is an abnormal congestion event. If the system determines local/sub-cluster to which the congestion event belongs, the system assigns or associates the congestion event directly to the global cluster, which includes the sub-cluster.

Referring to both FIGS. 1 and 5, a method begins at block 502, where a system detects a congestion event.

At block 504, the system determines the road associated with the congestion event. In various embodiments, the road may be identified by location and/or road name.

At block 506, the system determines a corresponding cluster model. For example, the system finding the cluster model corresponding to the road. In various embodiments, the system has already built a cluster model for each road, where the system uses each model to determine whether the occurring event is normal or not. The system then determines the local cluster if normal.

At block 508, the system determines, for each congestion event, if the congestion event is a normal congestion event versus an abnormal congestion event. Given the cluster model, the system uses the model to predict a congestion event. The prediction is based on the system scoring or checking the distance between the congestion event and the clusters in the model. If the congestion event is more similar to one of the clusters, the system determines the congestion event as a normal event. Otherwise, if the congestion event is not similar to any of the clusters in the model, the system determines the congestion event as an outlier (not normal). A particular measure may be used to evaluate the similarity.

At block 510, the system determines the local cluster if the congestion event is normal congestion. The system determines may determine the local cluster similarly to step 204 of FIG. 2.

At block 512, the system determines the global cluster. The system may determine the global cluster similarly to step 206 of FIG. 2.

At block 514, the system determines determine key drivers for the unusualness if the congestion event is not normal congestion (abnormal congestion). Key drivers are those attributes whose values are highly deviated from the distributions in sub-clusters. In various embodiments, key drivers are the attributes whose values are highly deviated from the normal ones. For example, if a congestion event on a road lasts for an unusually long time, the system determines the congestion event to be abnormal. There may be other unusual drivers such as, for example, unusual queue length, etc. Given such information, traffic management would better understanding of the congestion event.

In some embodiments, the system may assign a congestion event to a cluster if the congestion event also belongs to a normal sub-cluster. In other words, an abnormal congestion event will be detected in Stage 1, and the abnormal congestion event will not be included in regular congestion patterns.

Although the steps, operations, or computations may be presented in a specific order, the order may be changed in particular embodiments. Other orderings of the steps are possible, depending on the particular embodiment. In some particular embodiments, multiple steps shown as sequential in this specification may be performed at the same time. Also, some embodiments may not have all of the steps shown and/or may have other steps instead of, or in addition to, those shown herein.

Figure 6:
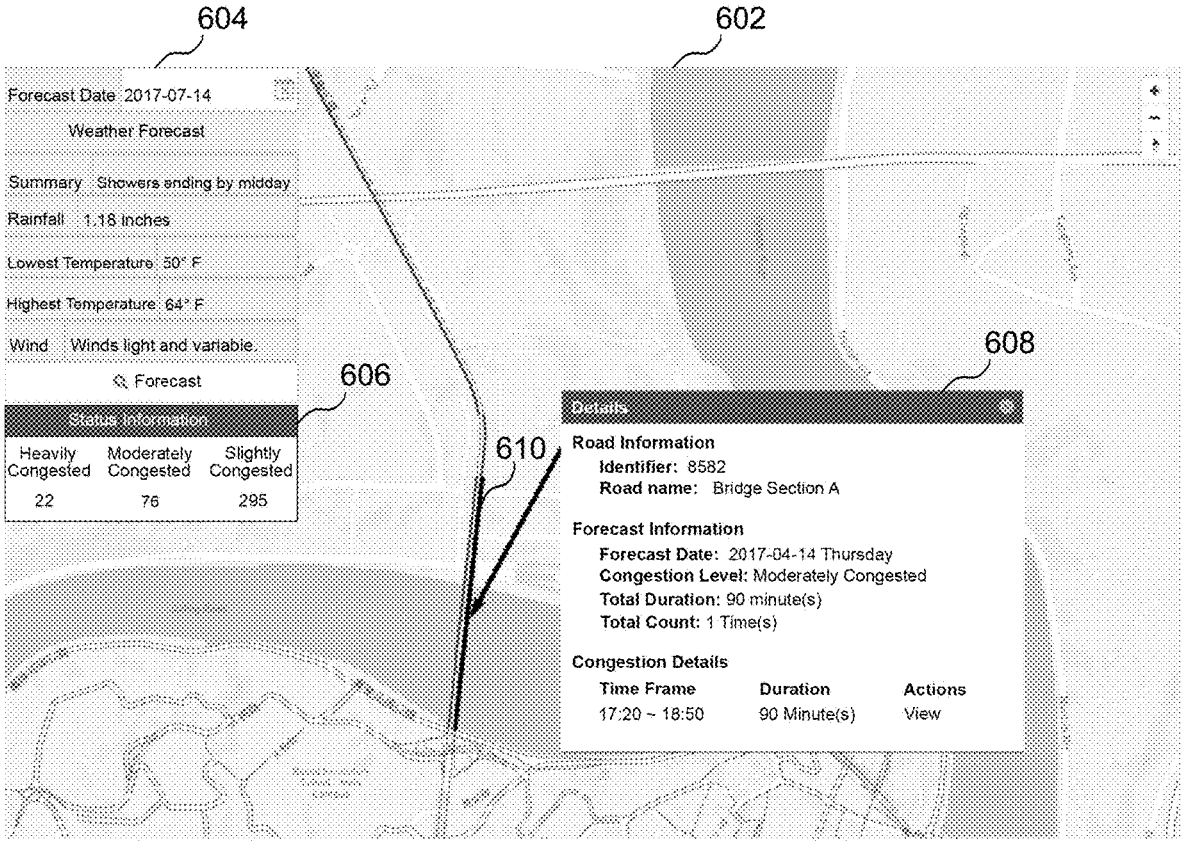
FIG. 6 is an example user interface showing detected local congestion information, according to some embodiments.

FIG. 6 is an example user interface 600 showing detected local congestion information, according to some embodiments. The user interface 600 shows a map 602 of a road network, a general information window 604, a congestion statistics information window 606, and a road information window 608. A bold line 610 demarcates a road section with traffic congestion. As shown, the bold line 610 indicates traffic congestion on the northbound lane. For ease of illustration, one road section is shown as having traffic congestion. In other scenarios, a given map may show multiple road sections with traffic congestion. In various embodiments, the system enables the user to select any congested road or road section on the map to check its particular information in road information window 608. The bold line 610 is the highlight to show which road section one is selected.

In various embodiments, the general information window 604 may display a forecast date (e.g., 2017 Jul. 14), summary (e.g., showers ending by midday), amount of rainfall (e.g., 1.18 inches), lowest temperature (e.g., 50° F.), highest temperature (e.g., 64° F.), wind conditions (e.g., winds light and variable), etc. The information displayed and details may vary, depending on the particular implementation and circumstances.

In various embodiments, the congestion statistics information window 606 may display the amount of congestion (e.g., heavily congested, moderately congested, and slightly congested), etc. In some embodiments, the congestion statistics information window 606 displays the amount of congestion for a particular road network. For the example, the information may cover a downtown district. As such, this information may cover a road network area that is larger than the area that the map shows. In various embodiments, the congestion statistics information window 606 may be defined by the inputs of the system. If the user selects traffic and road information for a particular region (e.g., for a downtown district, etc.), the congestion statistics information window 606 summarizes the traffic and road information, including congestion information, for that particular region. In another example, if the user selects traffic and road information for an entire city, the congestion statistics information window 606 summarizes the traffic and road information, including congestion information, for the whole city. In some embodiments, the congestion statistics information window 606 may also display how many road sections are heavily congested (e.g., 22 road sections), how many roads are moderately congested (e.g., 76 road sections), and how many roads are slightly congested (e.g., 295 road sections). The road section demarcated by the line bold line 610 is one of the road sections that is moderately congested. In some embodiments, the information shown in the congestion statistics information window 606 may adjust to the area actually shown in the displayed map, where the number of road sections included in the statistics will scale with the amount of the road network shown. The information displayed and details may vary, depending on the particular implementation and circumstances.

In various embodiments, the road information window 608 may display congestion-related information associated with the congestion at the bold line 610. In some embodiments, the congestion-related information may include road information such as a road identifier (e.g., road 8562), a road name (e.g., Bridge Section A), etc. The congestion-related information may also include forecast information such as forecast date (e.g., 2017 Apr. 14 Thursday), congestion level (e.g., moderately congested), total duration (e.g., 90 minutes), and number of congestion events (e.g., 1). In some embodiments, the total count is the number of congestion events for specified road. The forecast information may also include congestion details such as a time frame (e.g., 17:20-18:50) and duration (e.g., 90 minutes). The information displayed and details may vary, depending on the particular implementation and circumstances. Users such as city planners may use such information provided by user interface 600 to make decisions for resolving or alleviating traffic congestion.

Figure 7:
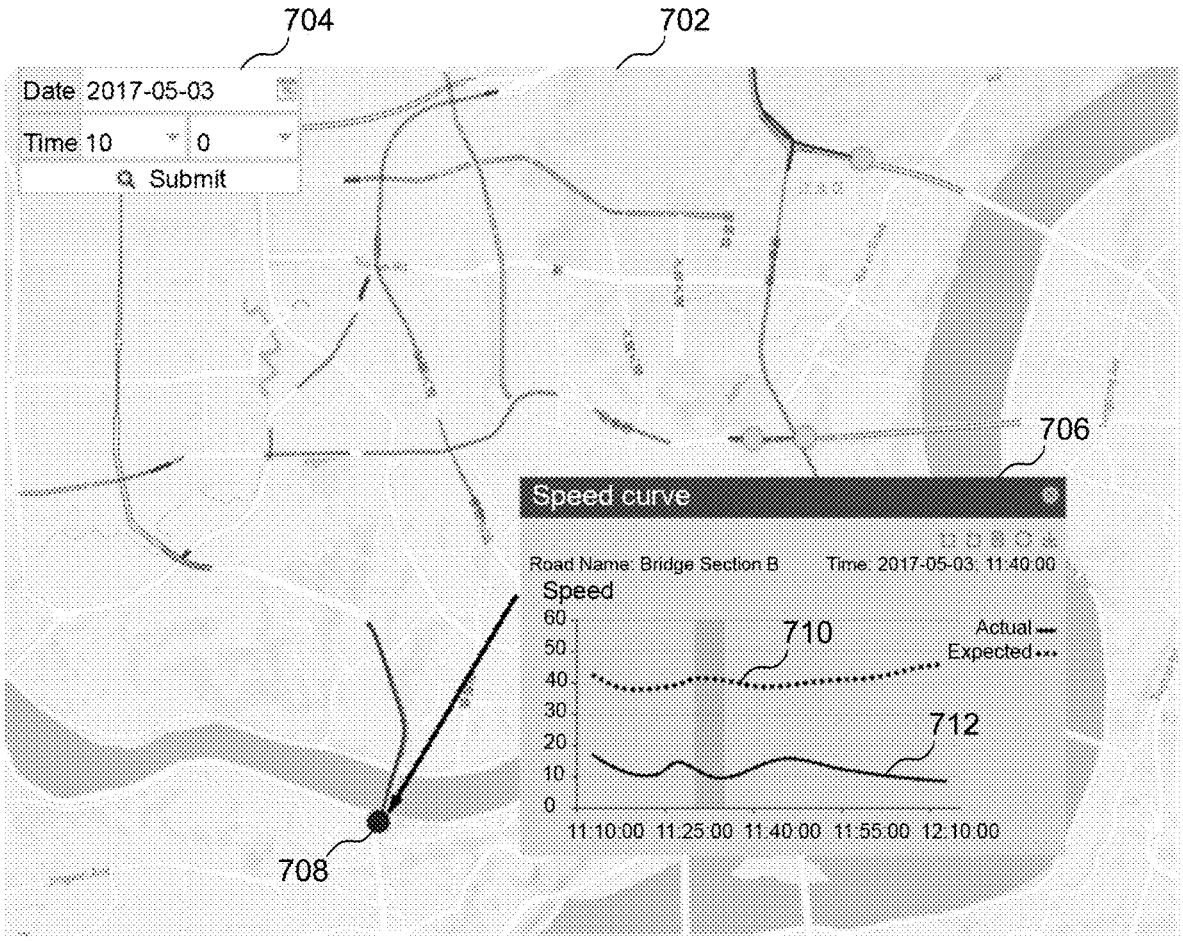
FIG. 7 is an example user interface showing identified abnormal congestion information, according to some embodiments.

FIG. 7 is an example user interface 700 showing identified abnormal congestion information, according to some embodiments. The user interface 700 shows a map 702 of a road network, a date and time window 704, and a congestion information window 706. A bold dot 708 demarcates a portion of a road having abnormal traffic congestion.

The date and time window 704 displays a date (e.g., 2017 May 3), a time (e.g., 10:00), and a submit button. In some embodiments, the date and time window 704 specifies a date/time of interest to the user. The submit button sets user's date/time in the system. The information displayed and details may vary, depending on the particular implementation and circumstances.

The congestion information window 706 displays speed information. In this particular example, the speed information shows a graph of speed versus time of day at the portion of the road demarcated with the bold dot 708. This example congestion event is shown at the south entrance of a particular bridge (e.g., Bridge Section B). In various embodiments, the average driving speed at a given moment is the key factor that distinguishes this sub-cluster from other sub-clusters of the local congestion pattern. The congestion information window 706 also displays the road name (e.g., Bridge Section B) and a time (e.g., 2017 May 3, 11:40:00). The information displayed and details may vary, depending on the particular implementation and circumstances.

The chart of the congestion information window 706 shows a dotted line 710 that indicates an expected traffic pattern under normal congestion pattern, and shows a solid line 712 that indicates the actual traffic congestion pattern. In this example, the difference between the normal congestion pattern and the actual traffic congestion pattern is significant such that the actual traffic congestion pattern is abnormal. While a certain amount of traffic congestion may be expected during a given time of day, abnormal traffic congestion may occur for various reasons. For example, there may be an auto accident, or bad weather conditions (e.g., flooding), etc. As indicated herein, in some embodiments, the system may not include abnormal congestion events in regular congestion patterns.

Embodiments described herein have various benefits. For example, embodiments determine traffic congestion patterns in a road network at a local road level as well as a global road network level. Embodiments apply a clustering method separately on each road in order to determine local traffic congestion patterns for the individual roads. Embodiments also apply a clustering method on the traffic congestion patterns in order to determine global traffic congestion patterns for the road network. Embodiments provide constructive traffic information for traffic planners to make decisions on how to resolve or alleviate traffic congestion. Embodiments indicate congestion patterns on particular roads of interest, and indicate if congestion patterns differ across roads. Embodiments determine on which roads a particular congestion pattern occurs most frequently. Embodiments determine if a particular congestion pattern is normal or abnormal.

Figure 8:
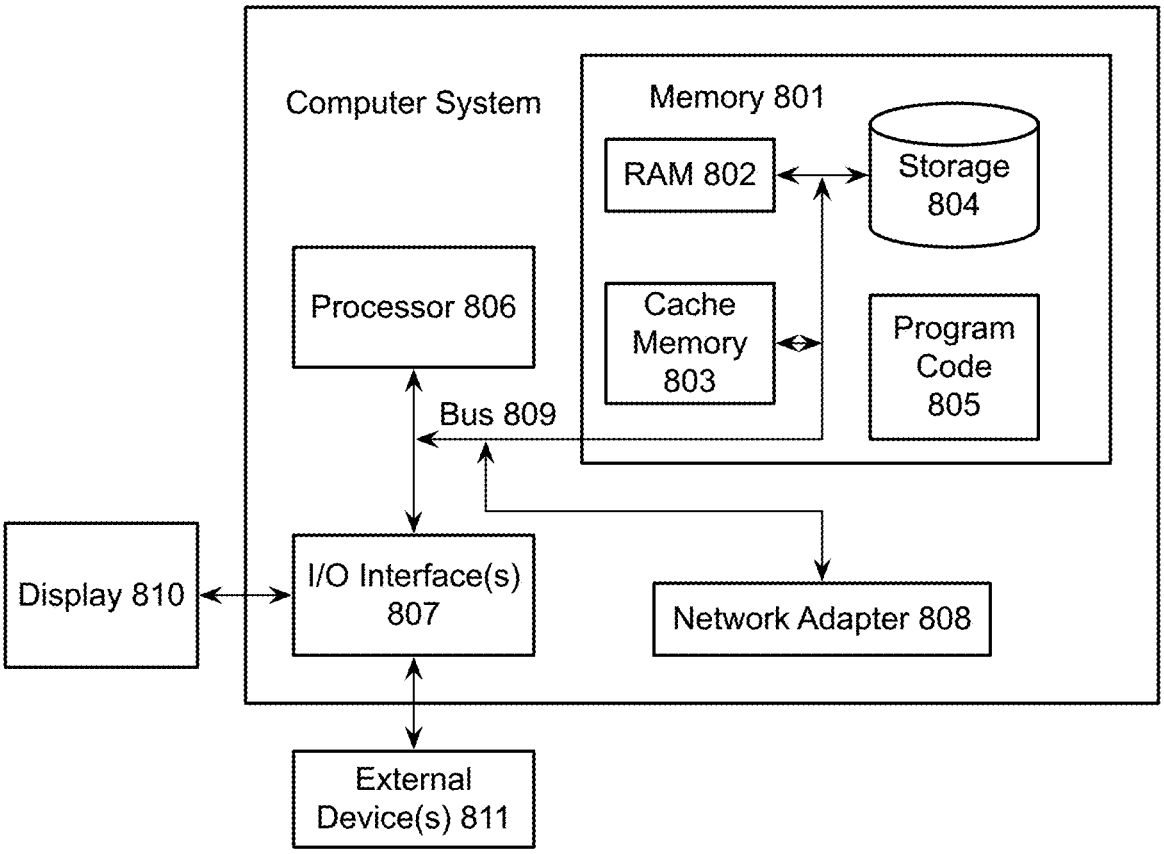
FIG. 8 is a block diagram of an example computer system, which may be used for embodiments described herein.

FIG. 8 is a block diagram of an example computer system 800, which may be used for embodiments described herein. The computer system 800 is operationally coupled to one or more processing units such as processor 806, a memory 801, and a bus 809 that couples various system components, including the memory 801 to the processor 806. The bus 809 represents one or more of any of several types of bus structure, including a memory bus or memory controller, a peripheral bus, an accelerated graphics port, and a processor or local bus using any of a variety of bus architectures. The memory 801 may include computer readable media in the form of volatile memory, such as random access memory (RAM) 802 or cache memory 803, or storage 804, which may include non-volatile storage media or other types of memory. The memory 801 may include at least one program product having a set of at least one program code module such as program code 805 that are configured to carry out the functions of embodiment of the present invention when executed by the processor 806. The computer system 800 may also communicate with a display 810 or one or more other external devices 811 via input/output (I/O) interfaces 807. The computer system 800 may communicate with one or more networks via network adapter 808.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD- ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may include copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A computer-implemented method comprising:

identifying a plurality of congestion events for each road of a plurality of roads in a road network, wherein each given congestion event indicates a drop in average vehicle speed below a predetermined speed threshold for a particular road in the road network, and wherein the plurality of congestion events span a predetermined time period;

determining local clusters of the congestion events for the particular road based using a clustering method on one or more road condition parameters wherein each local cluster defines a set of local congestion patterns for the particular road of the plurality of roads in the road network; and clustering, using a clustering method, respective ones of the local clusters into a plurality of global clusters, wherein a global cluster consists of a set of local clusters each having a similar congestion pattern, the set of local clusters for a plurality of respective ones of the plurality of roads and the global cluster is clustered independent of any spatial parameter.

2. The method of claim 1, wherein the at least one processor further performs operations comprising identifying each road in the road network based on a road location in the road network.

3. The method of claim 1, wherein the one or more road condition parameters further comprise traffic parameters.

4. The method of claim 1, wherein the one or more road conditions further comprise weather parameters.

5. The method of claim 1, wherein each congestion event is a regular congestion event.

6. The method of claim 1, wherein the determining local clusters of the congestion events uses a spatial parameter and the clustering of the local clusters into a plurality of global clusters does not use a spatial parameter.

7. The method of claim 1, wherein the determining local clusters of the congestion events uses only the events associated with a particular road are included in each local cluster and the clustering of the local clusters into a plurality of global clusters assigns different ones of the plurality of roads in the road network to a same global cluster.

8. The method of claim 1, wherein a first global cluster contains a first local cluster belonging to a first particular road and a first local cluster belonging to a second particular road and a second global cluster contains a second local cluster belonging to a first particular road and a second local cluster belonging to a second particular road.

9. The method of claim 1, wherein a first global cluster contains local clusters representing a first congestion pattern in the entire road network including a first local cluster belonging to a first particular road and a first local cluster belonging to a second particular road and a second global cluster contains local clusters representing a second congestion pattern in the entire road network including a second local cluster belonging to a first particular road and a second local cluster belonging to a second particular road.

10. The method of claim 1, wherein the identifying of each congestion event comprises:

identifying a stable congestion seed within the predetermined time period where the average vehicle speed is below the predetermined speed threshold for the particular road in the road network;

searching a database of traffic data backward in time from the stable congestion seed to determine a start time of the given congestion event and forward in time from the start time to determine an end time of the given congestion event, the start time established when the average vehicle speed decreases below the predetermined speed threshold and the end time established when the average vehicle speed increases above the predetermined speed threshold; and defining the given congestion event as a process of traffic congestion for a certain period of time from the start time to the end time, wherein the certain period of time varies between the plurality of congestion events.

11. The method of claim 1, wherein the method further comprises determining one or more road condition parameter values for each congestion event, wherein the one or more road condition parameter values include a vehicle queuing length for the particular road during the certain period of time.

* * * * *